US006109204A

United States Patent [19]

Hoey et al.

[11] Patent Number: 6,109,204

[45] Date of Patent: Aug. 29, 2000

[54] "STAY PUT" BOOKMARK

[76] Inventors: Janice Mary Hoey; Joseph M. Perry, both of 5133-22nd Ave., Kenosha, Wis. 53140

[21] Appl. No.: 09/170,415

[22] Filed: Oct. 13, 1998

[51] Int. Cl.[7] ..... B42D 9/00

[52] U.S. Cl. ..... 116/234; 116/239

[58] Field of Search ..... 116/234–240; 281/42, 45; D19/34

[56] References Cited

U.S. PATENT DOCUMENTS

| | | | |
|---|---|---|---|
| D. 346,399 | 4/1994 | Schad et al. | D19/34 |
| 634,768 | 10/1899 | Sawyer | 116/238 |
| 700,453 | 5/1902 | Thomas | 281/42 |
| 1,579,438 | 4/1926 | Cortelyou | 281/42 |
| 2,674,972 | 4/1954 | Luther | 116/236 |
| 3,011,471 | 12/1961 | Tam | 116/238 |
| 3,020,876 | 2/1962 | Riden | 116/238 |
| 5,325,959 | 7/1994 | Goldberger | 116/239 |

FOREIGN PATENT DOCUMENTS

| | | | |
|---|---|---|---|
| 728303 | 7/1932 | France | 116/239 |

*Primary Examiner*—Andrew H. Hirshfeld
*Attorney, Agent, or Firm*—Jansson, Shupe, Bridge & Munger, Ltd.

[57] ABSTRACT

The disclosure involves an improved bookmark which will mark the reader's place in the book without becoming inadvertently dislodged and without damaging the book. The device is easily removable for reuse at an alternative location in the book. The device may also be manufactured inexpensively out of a wide range of materials. Various embodiments provide for alternative adjustment possibilities to enhance ease of use.

6 Claims, 5 Drawing Sheets

"STAY PUT" BOOKMARK

FIELD OF THE INVENTION

This invention relates generally to bookmarks and, more particularly, to bookmarks that do not easily dislodge from their position in a book and which are adjustable to fit all sizes and shapes of books.

BACKGROUND OF THE INVENTION

To an avid reader with a busy life, bookmarks are indispensable. Since it is difficult for most people to finish a book in one sitting, the pages where the reader has left off must be marked and remarked as the reader progresses through the book. Frequently, in this manner, the reading of a single text is accomplished in multiple sittings, requiring the reader to interrupt the process and resume reading the book when convenient.

A single book may also be read in multiple locations, whereby it is carried by the reader from place to place until it is finished. For example, a single book may be read while in bed, at the doctor's office while waiting for an appointment, in a park over a lunch hour or even while exercising on a stationary bike at the local gymnasium. Consequently, an unfinished book may frequently need to be carried from one location to another as the author progresses through the book. This necessitates marking and remarking the stopping points in the book in a secure manner so that the proper stopping point is designated regardless of the physical movement of the book from one location to another.

Sometimes it is also desirable to use bookmarks to facilitate the ready location of a particular page in a book that the reader may use frequently. For example, it may be desirable to mark a particular recipe in a cookbook or a favorite poem in a poetry book so that the excerpt can be located and referred to quickly.

A book containing a bookmark may be stored in various places while being read, including purses or briefcases. It may be stored in a flat position on its back cover when placed on a bedside table, in an upright position when stored in a bookcase, or in various other positions while being transported.

The known bookmarks of the prior art tend to be in the nature of paper or plastic coated paper strips, string or cloth which are intended to be inserted between the pages of a book after the page last read. By inserting such devices so that they project beyond the upper edge of the book and placing the book on its back cover, the place where the reader left off may be quickly and easily found again when desired. This avoids the necessity of searching through pages of text to find the reader's place or pick up the story.

This method may be sufficient if the book is placed in a horizontal position and lies undisturbed on a bedside table, to be picked up again the next night at the same location. This is because the weight of the finished pages of the book and the force of gravity will hold the bookmark in its place when the book is lying horizontally.

However, such bookmarks have certain disadvantages and limitations. For example, these bookmarks are not particularly useful if the book is placed vertically on end, as may be the case if the book is carried from place to place in a purse, knapsack or briefcase, or if the book is inadvertently dropped. Under such circumstances, the force of gravity and the lack of weight holding the bookmark in place often results in the bookmark falling loosely to the center of the book and could result in its becoming dislodged from the book altogether. At that point, the reader must then examine the book closely to determine where the reader left off—a process that can be frustrating and time consuming and which negates the value of using a bookmark at all.

Other devices in the prior art that have been used as bookmarks are in the nature of clips which can be fastened or clipped to a particular page in the book. Such devices have the disadvantage of potentially causing a permanent mark on, or permanent damage to, the book pages. Such devices can cause permanent marking, bending or tearing of the paper pages due to the weight of the marker on a particular page, making such devices undesirable.

OBJECTS OF THE INVENTION

It is an object of the invention to provide a bookmark which will stay in the desired position in a book regardless of the position of the book.

A further object of the invention is to provide a bookmark that will stay in place in the book even when the book is transported from one location to another.

Another object of the invention is to provide a bookmark that is inexpensive to manufacture.

A further object of the invention is to provide a bookmark that can be adjusted to fit a broad range of sizes and thicknesses of books.

Yet another object of the invention is to provide a bookmark that can be easily manufactured out of many different types of materials and in many different shapes and sizes.

Another object of the invention is to provide a bookmark which easily marks a page in a book without any damage to the book or its pages.

Still another object of the invention is to provide a bookmark that is readily removed from the book and easily reinserted in the same or another book.

A further object of the invention is to provide a bookmark which can be easily and inexpensively decorated in the manner desired.

How these and other objects are accomplished will become more apparent from the following descriptions and from the drawings.

SUMMARY OF THE INVENTION

The invention involves a device used to mark pages in a book or other reading material. In the improvement, the device has a base having a base front, a base back, a base top and a base bottom, as well as a marking means. The marking means has a first end and a second end. The first end of the marking means and the second end of the marking means are attached to the base.

In one embodiment of the device, the second end of the marking means is removably attached to the base. The second end of the marking means may be removably attached to the base front by means of hook and eye fasteners such as Velcro. Alternatively, the second end of the marking means may be removably attached to the base front by means of snaps.

In another embodiment of the invention, the base has a first hole on the base top and a second hole on the base bottom. The first end of the marking means is attached to the base in the first hole and the second end of the marking means is attached to the base in the second hole. The base may be elastic, rigid or flexible. Likewise, the marking means may be elastic, rigid or flexible.

Another aspect of the invention is a book, in combination with a device used to mark pages in a book or other reading material. This device has a base which has a base front, a base back, a base top and a base bottom. It also has a marking means with a first end and a second end, wherein the first end of the marking means and the second end of the marking means are attached to the base. In this aspect, the base back may be affixed to the book.

In another preferred embodiment, the invention is a device used to mark pages in a book or other reading material, the device having a base, with a base front, a base back, a base top and a base bottom; a marking means, having a first end, a second end and a marking means length measured by the distance between the first end and the second end; a marking means adjusted second point along the marking means length, between the marking means first end and the marking means second end, and an adjusted marking means length measured by the distance between the marking means first end and the marking means adjusted second point; means to hold the marking means in fixed position relative to the base at the marking means adjusted second point; and means to increase or reduce the adjusted marking means length by adjusting the marking means adjusted second point, wherein the marking means first end is connected to the base and the marking means second end is connected to the length adjustment means.

In this embodiment, the length adjustment means may be a wheel having a wheel diameter attached to the base front, whereby a portion of the marking means length may be wound around such wheel to thereby increase or reduce the adjusted marking means length. A crank may also be attached to the wheel to allow easy turning of the wheel.

In another aspect of the device, a faceplate may be removably attached to the base, thereby allowing access to the wheel when adjustment of the marking means is desired. Or, the device may include a rotatable faceplate attached to the base top, wherein said faceplate may be rotated away from the base to access the wheel when adjustment of the marking means is desired or rotated toward the base to cover at least a portion of the wheel and a portion of the base when adjustment is completed.

Another alternative is for the device to have a faceplate, having lateral edges and a width, which is attached to the base and covers at least a portion of the wheel. In this embodiment, the wheel has a diameter greater than the width of the faceplate, whereby the wheel extends beyond the lateral edges of the faceplate.

In still another preferred embodiment, the device is used to mark pages in a book or other reading material and the device has a base with a base front, a base back, a base top and a base bottom; a marking means, having a first end, a second end and a marking means length measured by the distance between the first end and the second end; a marking means adjusted first point and a marking means adjusted second point along the marking means length between the marking means first end and the marking means second end, and an adjusted marking means length measured by the distance between the marking means adjusted first point and the marking means adjusted second point; means to hold the marking means in fixed position relative to the base at the marking means adjusted first point; means to hold the marking means in fixed position relative to the base at the marking means adjusted second point; means to increase or reduce the adjusted marking means length by adjusting the marking means adjusted first point and the marking means adjusted second point.

In this embodiment of the device, the length adjustment means may be two wheels attached to the base front whereby a portion of the marking means length may be wound around each such wheel to thereby increase or reduce the adjusted marking means length.

Other aspects of the invention are set forth in the following detailed description and in the drawings.

DETAILED DESCRIPTION OF PREFERRED EMBODIMENTS

Figure 1:
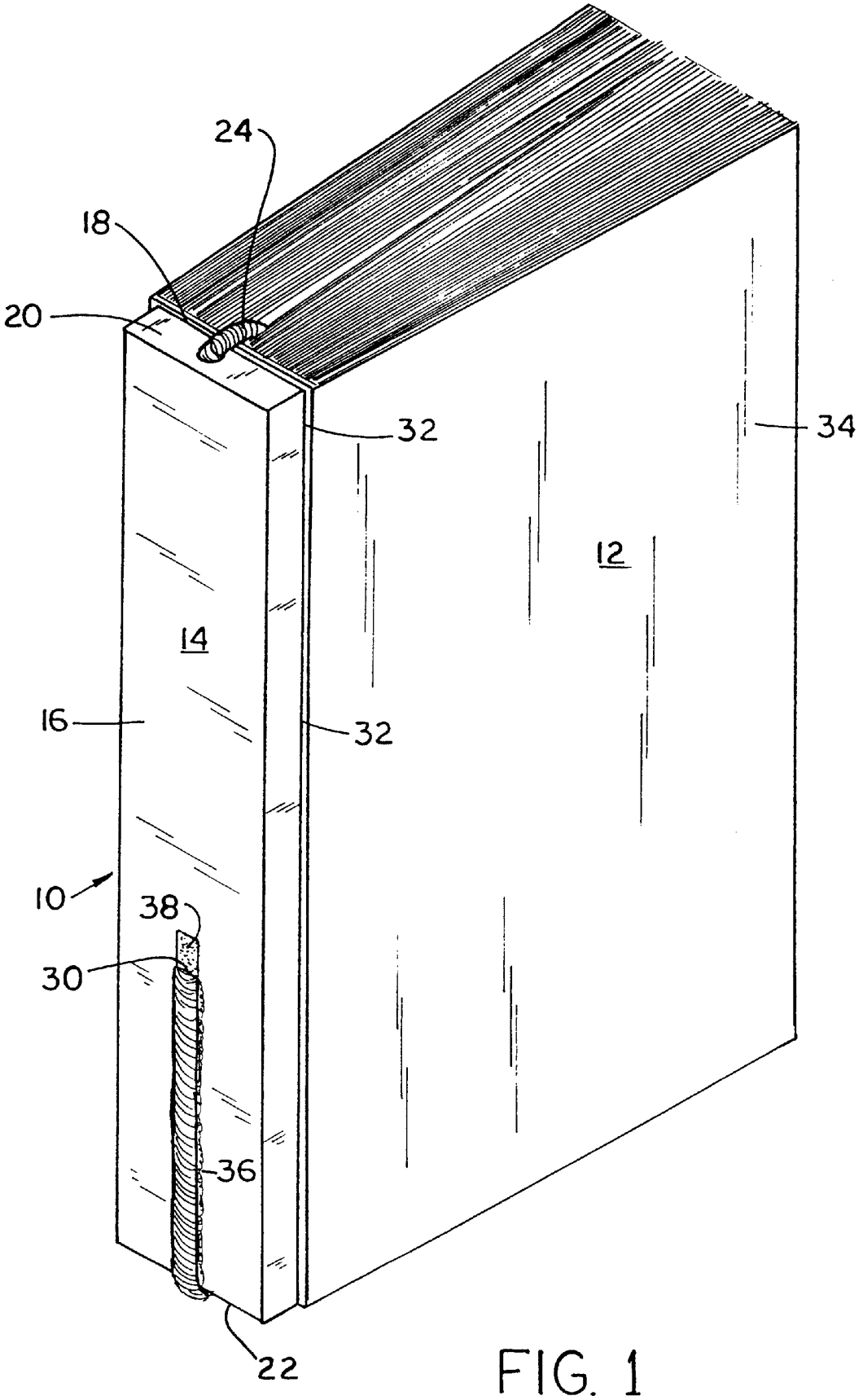
FIG. 1 is a perspective view of an embodiment of the device attached to a book.

FIG. 1 shows a perspective view of the new inventive device 10 when in use on a book 12. The device 10 consists of a base 14, having a base front 16, a base back 18, a base top 20 and a base bottom 22. Also shown in FIG. 1 is a marking means 24. The marking means 24 is designed to be inserted between the pages of the book 12 or other reading material just after the last page read so that the reader, upon resuming his reading of the book 12, can immediately locate where he left off in the book 12 by turning to the marking means 24. The device 10 must therefore be capable of being easily removed from the book 12 and easily replaced therein at another location in the book. Preferably, the device 10 is capable of use on a wide variety of books 12 in terms of size and shape.

The base 14 can be manufactured from various types of materials, depending upon the objectives of the user. It can be configured from rigid materials, such as metal, plastic, ceramic, glass, wood, or even cardboard strengthened by a plastic coating. Such materials have the advantage of long-term durability and can be easily engraved or decorated. Alternatively, the base 14 can be made from a flexible, soft material such as fabric, which is relatively inexpensive, easy to decorate or personalize, and easy to fold and store when not in use. Because the device 10 may often be carried, it is preferable for the material used to be lightweight.

It also could be advantageous in some embodiments of the invention to use a width of elasticized fabric for the base, so that the length of the base 14 is expandable. Under such circumstances, the marking means 24 could be rigid and the marking means length 26 fixed, since the use of elastic material on the base 14 would allow the device 10 to be removed and replaced on a book 12, although it may limit the variations of books 12 on which such a device 10 could be used.

Figure 2:
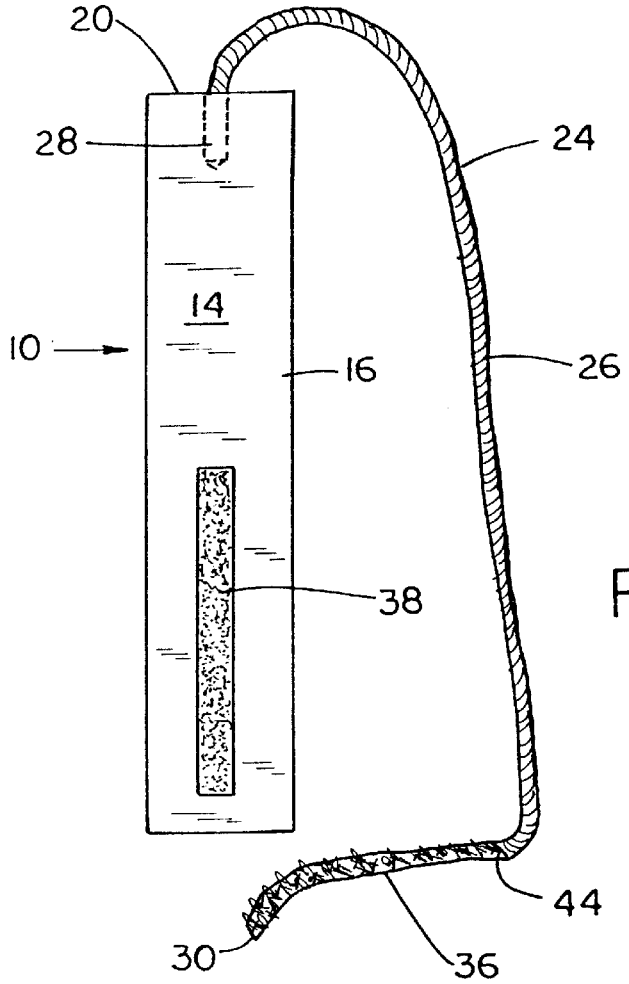
FIG. 2 is a front view of the device showing the second end of the marker unattached to the base.
Figure 3:
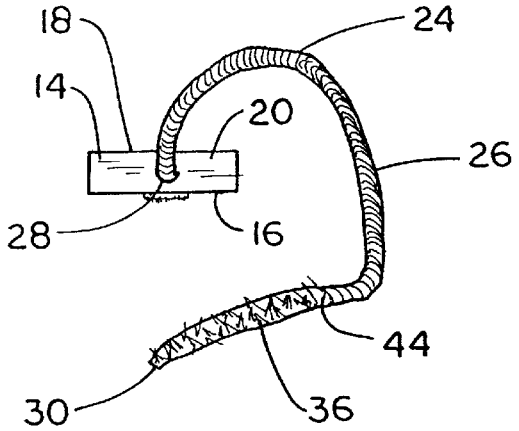
FIG. 3 is a top view of the device shown in FIG. 2.
Figure 4:
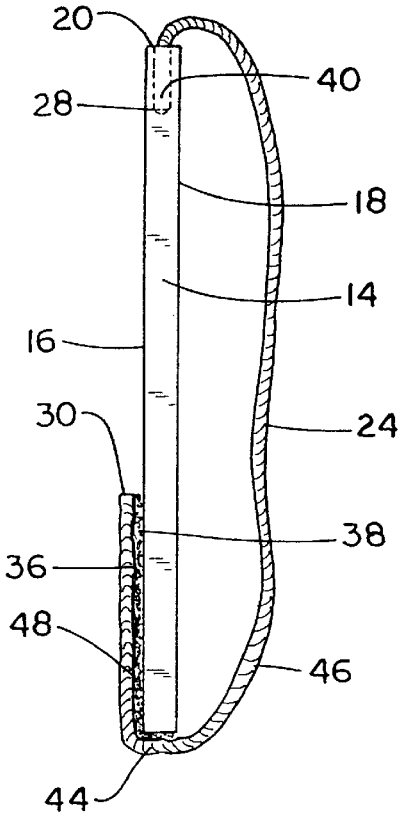
FIG. 4 is a side view of the device showing the second end of the marker removably attached to the base.
Figure 5:
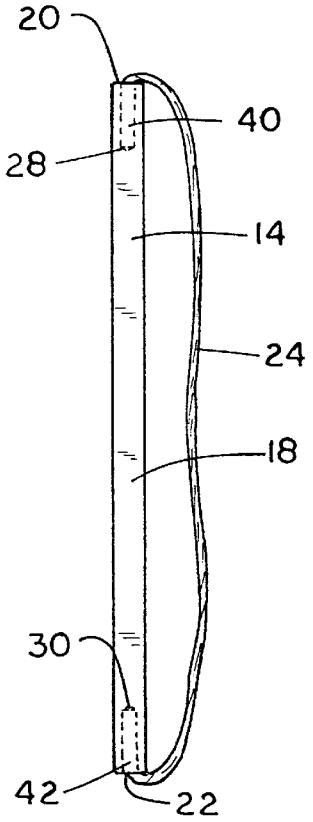
FIG. 5 is a side view of an embodiment of the device showing the first end of the marker and the second end of the marker permanently attached to the base.

As shown in FIGS. 2, 4 and 5, the marking means 24 has a first end 28 and a second end 30. In order to effectively retain a fixed location in the book 12, the marking means 24, in a preferred embodiment, is attached at the first end 28 and at the second end 30 to the base 14.

The marking means 24 can also be manufactured from a wide variety of materials, including rigid materials such as wire, or flexible materials such as ribbon, fabric, yarn or string. The marking means 24 could also be made of elastic fabric, which would allow the marking means length 26 to expand for removal and replacement purposes in the book 12, thereby allowing fixed attachment at the first end 28 and at the second end 30 to the base 14. Such an example can be seen in FIG. 5.

Figure 6:
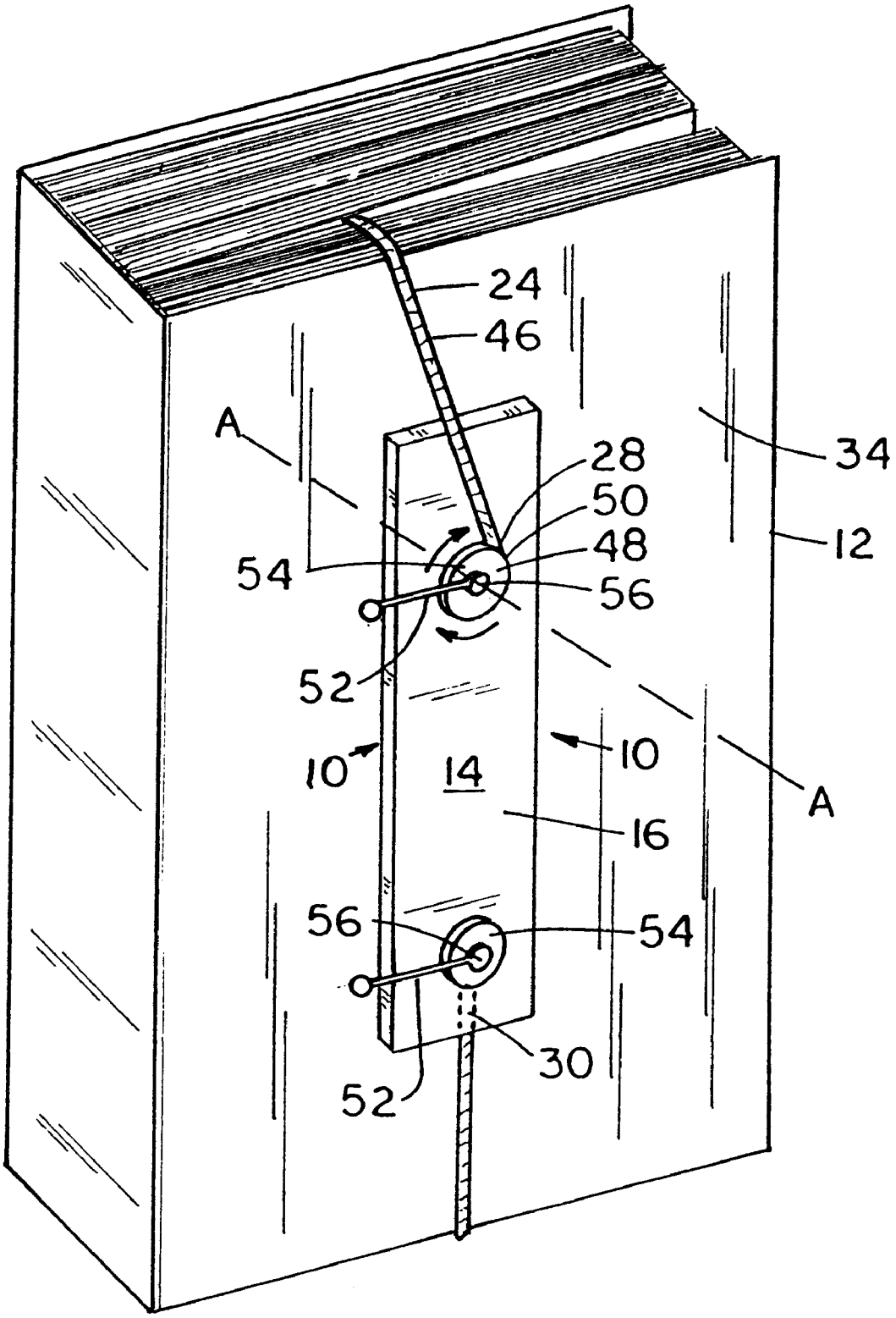
FIG. 6 is a perspective view of the device attached to a book showing the use of a crank to tighten the marker at one end.

FIGS. 1, 2, 3, and 4 show a preferred embodiment of the device 10, having a fixed attachment to the base 14 at the first end 28 and a removable attachment to the base 14 at the second end 30. In this embodiment, the base 14 is generally rectangular and flat in shape. This shape accommodates placement on either the book spine 32 (as shown in FIG. 1) or the book cover 34 (as shown in FIG. 6) and is attractive in appearance without excess bulk.

However, the base 14 could be manufactured in a wide variety of shapes and sizes, thereby accommodating different design preferences or book sizes. The base 14 could also be designed to provide an eraserable surface on the base front 16 or a note pad for those in book groups or those generally interested in jotting down thoughts or recollections as reading through the book 12.

The removable attachment of the second end 30 of the marking means 24 can be achieved in various ways. For example, a portion of the marking means length 26 near and at the marking means second end 30 could be covered by a hook-and-eye, or Velcro-type, marking means fastening material 36 (see FIGS. 2 and 3), which could then be removably joined at various points along its length with a length of the base mating material 38 (see FIGS. 1 and 2) affixed to the base front 16, as shown in FIGS. 1, 2 and 4. Such a design affords some adjustability in the size of books 12 it will accommodate, depending upon the marking means length 26, the length of the marking means fastening material 36, and the size and placement of the base mating material 38.

The device 10, as shown in FIGS. 1, 2 and 4, is used by placing the base 14 on the book spine 32 or book cover 34, inserting the marking means 24 from the fixed first end 28 between the pages to be marked (as shown in FIG. 1) and folding the marking means fastening material 36 affixed to the second end 30 over the base mating material 38. With this device 10, the desired place in the book 12 will be secure even if the pages of the book 12 open up or the book 12 is inadvertently dropped. When reading is resumed, the marking means fastening material 36 is simply pulled away from the base mating material 38 by the user. In this manner, pages in the book 12 can be marked and remarked in secure fashion without damage to the book 12.

Placing the device 10 on the book spine 32 has the advantage of allowing one reader of a book 12 to mark his or her place while still allowing the book 12 to be read by a second reader, since pages may be turned without dislodging the device 10. Conceivably, two people could each use a separate device 10 concurrently on the same book 12 by placing the base back 18 of one on top of the base front 16 of the other on the book spine 32, or, alternatively, placing one device 10 on the book spine 32 and a second device 10 on the book cover 34. Different indicia, designs or coloration on each device 10 could be used to clearly indicate which device 10 belonged to which reader.

Alternative methods of securing the marking means second end 30 to the base front 16 could also be employed in different embodiments of the device 10. For example, the device 10 could be fastened by the use of snaps, potentially fixed in series on the base front 16 or on the marking means 24 to afford some adjustability.

Likewise, clips could be employed as a closure option.

FIG. 5 shows an embodiment of the device 10 which provides for a marking means 24 that is attached to the base 14 in fixed position at the first end 28 and at the second end 30. In this embodiment, the marking means 24 is preferably elastic or adjustable along some portion of the marking means length 26.

In this preferred embodiment, the base 14 must be rigid and have sufficient thickness to accommodate the boring of a first hole 40 on the base top 20 and a second hole 42 on the base bottom 22. The marking means first end 28 is attached to the base 14 in the first hole 40 and the marking means second end 30 is attached to the base 14 in the second hole 42. Alternative embodiments can be manufactured by combining a marking means first end 28 attached to the base 14 in the foregoing manner with an adjustable marking means second end 30 as previously described.

In another embodiment, the invention is a book 12 in combination with the device 10 described previously in its varying embodiments. In this combined embodiment, the device 10 may be permanently affixed at the base back 18 to the book 12 by glue, or removably affixed by velcro attachment.

Another preferred embodiment of the device 10 combines the base 14, the marking means 24 and a marking means adjusted second point 44 along the marking means length 26. This embodiment provides for an adjusted marking means length 46, which is measured by the distance between the marking means first end 28 and the marking means adjusted second point 44. The embodiment provides for the means to increase or reduce the adjusted marking means length 46, as desired, by adjusting the marking means adjusted second point 44. This is accomplished by attaching the marking means first end 28 to the base 14 and the marking means second end 30 to the length adjustment means 48.

Alternatively, the marking means first end 28 may be attached to the length adjustment means 48 and the marking means second end 30 may be affixed to the base 14 (as shown in both FIGS. 6 and 7), whereby the means to increase or reduce the adjusted marking means length 46 is accomplished by adjusting the marking means adjusted first point 50. Another alternative embodiment could provide for length adjustment means 48 at both the marking means first end 28 and the marking means second end 30, thereby providing for both a marking means adjusted first point 50 and a marking means adjusted second point 44, and thereby provide for adjustment at both ends of the marking means 24. Under these circumstances, the adjusted marking means length 46 is measured by the distance between the marking means adjusted first point 50 and the marking means adjusted second point 44. Yet another alternative could provide for a marking means first end 28 fixed to the base 14, a marking means second end 30 fixed to the base 14, and length adjustment means 48 affixed solely to the marking means 24.

Figure 7:
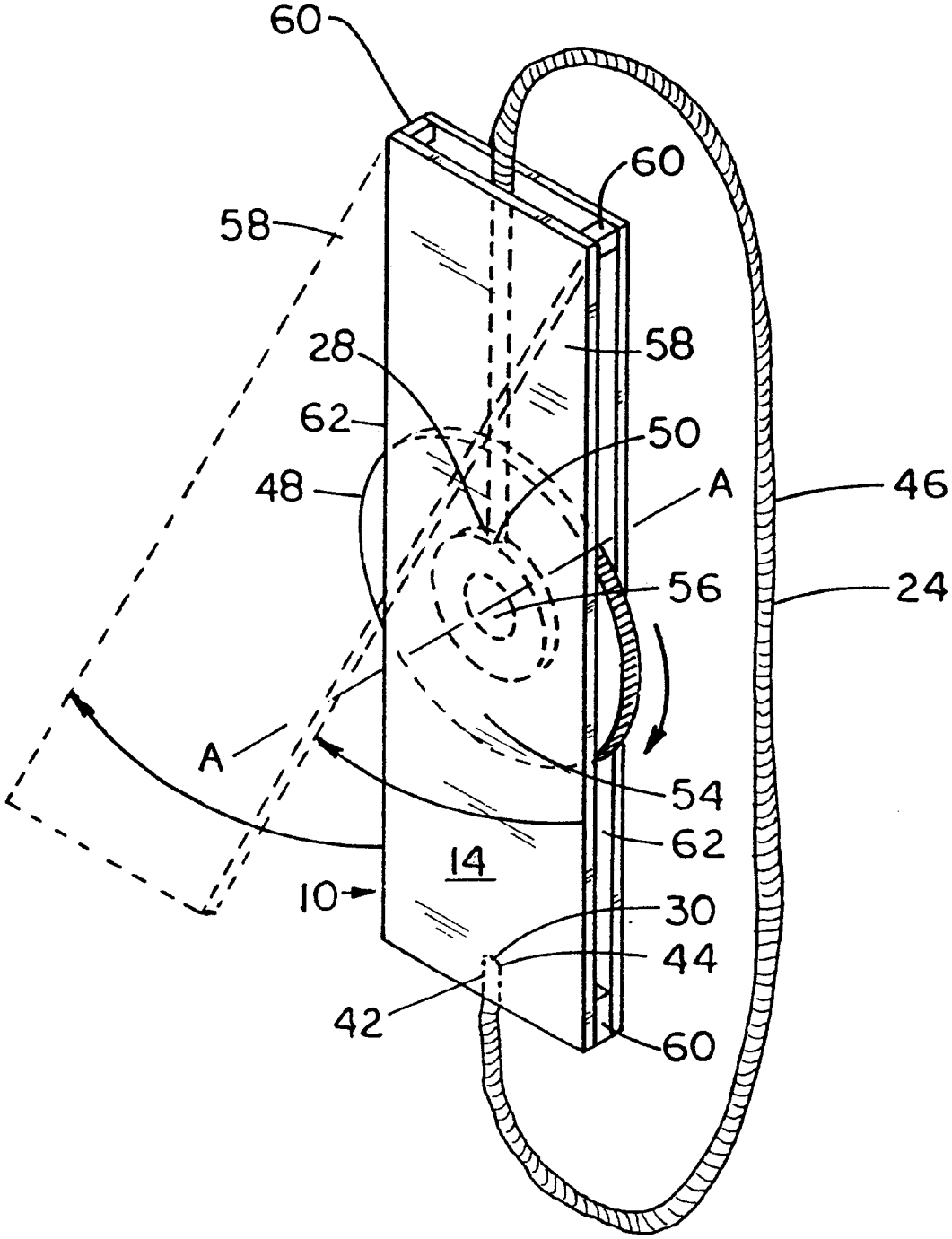
FIG. 7 is a perspective view of an embodiment of the device showing a faceplate on top of the base having a marker adjusting means of a wheel situated between the faceplate and the base.

Examples of alternative length adjustment means 48 are shown in FIGS. 6 and 7. FIG. 6 shows the use of a crank 52 attached to a wheel 54 affixed in its center 56 to the base front 16 in such a manner as to allow free rotation of the wheel 54. In the embodiment shown in FIG. 6, the marking means second end 30 is affixed to the base 14 in the second hole 42. The marking means first end 28 may be attached to the wheel 52 by any of a number of methods, including fixed attachment. Alternatively, it may be held in place by the weight of the length of marking means 24 wrapped around the wheel 52 over the marking means first end 28, similar to the manner in which thread is held in place on a bobbin.

The device 10 is used to mark the appropriate page in the book 12 by inserting the lengthened marking means 24 between the appropriate pages and tightening the marking means 24 on the book 12 by reducing the adjusted marking means length 46. The adjusted marking means length 46 is reduced by rotating the wheel 54 in the direction in which the marking means 24 is wound around the wheel 54. As the wheel 54 is turned, the marking means 24 wraps around the wheel 54 until the device 10 is held tightly in place on the book 12. The crank 52, as an attachment to the wheel 54, while not necessary to its function, makes it easier for the user to turn the wheel 54 since it is easier to grasp the crank 52 than the wheel 54 directly.

In this embodiment, the wheel 54 is easily turned by rotating the crank 52 around the center axis A—A of the wheel 54. The adjusted marking means length 46 achieved can then be held in fixed position by temporarily locking it in position at the marking means adjusted first point 50 and/or the marking means adjusted second point 44 depending upon the embodiment and the location of the length adjustment means 48. This objective may be accomplished by any number of various locking means, including a locking tab that allows the marking means 24 to travel in reverse direction around the wheel 54 only when in an "up" position, or a clip on the crank 52.

As an alternative embodiment, the fixed marking means second end 30 shown in FIG. 6 may also terminate on a wheel 54 identical in appearance and function to the wheel 54 to which the first end 28 is attached to provide further adjustability of adjusted marking means length 46. Such a wheel 54 may also have a crank 52 attached to its center 56 for easier use.

Any of the foregoing alternative embodiments can also include a rotatable face plate 58 (as shown in FIG. 7). This faceplate 58 preferably approximates the size and shape of the base 14, but could vary in size to create an alternative appearance or to save on material expenditures. The faceplate is attached to the base 14 by hinges or a similar method to the base front 16 in such a manner that it can readily be rotated in an upwardly direction away from the base 14 by the user if access to the length adjustment means 48 is desired. The faceplate 58 may then be rotated downwardly to cover the base 14 or a portion thereof when adjustment is completed. The faceplate 58, since it covers the wheel 54 or other length adjustment means 48, has the advantage of providing a "clean" surface for easy decoration as desired.

A preferred embodiment of the device 10 incorporating a faceplate 58 would provide for the faceplate 58 to lock in position on the base 14 when adjustment was not required. Alternative possibilities of fastening the faceplate 58 to the base 14 also exist, including the possibility of a completely removably faceplate 58 which could engage the base 14 and thereby lock onto the device 10, or a hinged connection at any other location along the base 14. Obviously, the faceplate 58 must have sufficient depth and size to accommodate any length adjustment means 48 attached to the base front 16, including any wheel 54 or crank 52 thereon.

In another embodiment of the device 10, as shown in FIG. 7, the device has a wheel 54 attached at the wheel center 56 to the base 14 and a faceplate 58. However, in this embodiment, the diameter of the wheel 54 is greater than the width of the base 14 and the faceplate attachment means 60 between the base 14 and the faceplate 58 is configured in such a way as to provide a slots 62 along the length of the device 10 through which the wheel 54 extends. In this way, the user has access to the wheel 54 in order to rotate it to tighten or loosen the marking means 24 around the book 12.

While the principles of the invention have been described in connection with exemplary embodiments, it should be understood clearly that such descriptions are by way of example and are not limiting.

What is claimed is:

1. A device used to mark pages in a book or other reading material, the device having a base, having a base front, a base back, a base top and a base bottom;

a marking means, having a first end, a second end and a marking means length measured by the distance between the first end and the second end;

a marking means adjusted second point along the marking means length, between the marking means first end and the marking means second end, and an adjusted marking means length measured by the distance between the marking means first end and the marking means adjusted second point;

means to hold the marking means in fixed position relative to the base at the marking means adjusted second point; and a wheel having a wheel diameter attached to the base front, wherein the marking means first end is connected to the base and the marking means second end is connected to the wheel, whereby the adjusted marking means length may be increased or reduced by adjusting the marking means adjusted second point by winding or unwinding a portion of the marking means length around the wheel.

2. The device of claim 1 wherein a crank is attached to the wheel to allow easy turning of the wheel.

3. The device of claim 1 wherein a faceplate is removably attached to the base, thereby allowing access to the wheel when adjustment of the marking means is desired.

4. The device of claim 1 wherein a rotatable faceplate is attached to the base top, wherein said faceplate may be rotated away from the base to access the wheel when adjustment of the marking means is desired or rotated toward the base to cover at least a portion of the wheel and a portion of the base when adjustment is completed.

5. The device of claim 1 wherein a faceplate having lateral edges and a width is attached to the base;

the faceplate covers at least a portion of the wheel; and the wheel has a diameter greater than the width of the faceplate, whereby the wheel extends beyond the lateral edges of the faceplate.

6. A device used to mark pages in a book or other reading material, the device having a base, having a base front, a base back, a base top and a base bottom;

a marking means, having a first end, a second end and a marking means length measured by the distance between the first end and the second end;

a marking means adjusted first point and a marking means adjusted second point along the marking means length between the marking means first end and the marking means second end, and an adjusted marking means length measured by the distance between the marking means adjusted first point and the marking means adjusted second point;

means to hold the marking means in fixed position relative to the base at the marking means adjusted first point;

means to hold the marking means in fixed position relative to the base at the marking means adjusted second point;

two wheels attached to the base front whereby the adjusted marking means length may be increased or reduced by winding or unwinding a portion of the marking means length around each wheel, thereby adjusting the marking means adjusted first point and the marking means adjusted second point.

* * * * *